United States Patent [19]

Fahlen

[11] 4,238,870

[45] Dec. 16, 1980

[54] BRUSH-BEATER ROLLER FOR A VACUUM CLEANER

[75] Inventor: Karl L. Fahlen, Marsta, Sweden

[73] Assignee: Aktiebolaget Electrolux, Stockholm, Sweden

[21] Appl. No.: 57,551

[22] Filed: Jul. 16, 1979

Related U.S. Application Data

[63] Continuation of Ser. No. 897,446, Apr. 18, 1978, abandoned.

[30] Foreign Application Priority Data

Apr. 29, 1977 [SE] Sweden ..... 7705003

[51] Int. Cl.[3] ..... A47L 5/30; A46B 13/02

[52] U.S. Cl. ..... 15/389; 15/183

[58] Field of Search ..... 15/179, 182, 183, 389-392

[56] References Cited

U.S. PATENT DOCUMENTS 3,683,444 8/1972 Schaefer et al. ..... 15/183

*Primary Examiner*—Christopher K. Moore

*Attorney, Agent, or Firm*—Alfred E. Miller

[57] ABSTRACT

A brush-beater roller for a vacuum cleaner in which the roller is elongated and is helically twisted about its longitudinal axis, said roller having elongated dovetail slots for accommodating a brush bristle holder, and a beater bar. The dovetail slots are arranged to receive radial projections on the integral belt pulley which correspond in shape to the dovetail slots. The roller further has means thereon for preventing the bristle holders from coming out of the dovetail slot upon rotation of the roller.

5 Claims, 4 Drawing Figures

BRUSH-BEATER ROLLER FOR A VACUUM CLEANER

This is a continuation of application Ser. No. 897,446, filed Apr. 18, 1978, now abandoned.

BACKGROUND OF THE INVENTION

This invention relates to a brush-beater roller for a vacuum cleaner and the like. The roller comprises an elongated body of generally rectangular cross section which is rotatably supported in a casing and connected to a drive belt pulley. The body of the roller is helically twisted about its length axis and has along its short sides, as seen in the cross section, dovetail slots intended to accommodate bristle holders or beating bars.

A brush-beater roller of the above type is known by German Application No. 2,264,546. In this known brush-beater roller the drive belt pulley is divided into two halves which, on assembly, are applied to the brush roller body from opposite sides and are then riveted or screwed together. The belt pulley is mounted in a circular groove in the roller body and has axial projections extending into dovetail slots arranged for the bristle holders in order to prevent relative turning between the belt pulley and brush-beater roller body.

However, the construction of the drive belt pulley of the above-described known roller is complex, and the assembly of the parts makes it necessary to have a pulley which is divided into two halves. Since the two halves must be later joined together on assembly, more working steps are required than if the pulley were an integral piece.

In another brush-beater construction, also of known type, the brush roller body is divided in an axial section into two symmetrical halves, with grooves for a shaft extending through the center of the roller body. Each roller half is provided with projections co-acting with milled slots or grooves in the shaft for axial guiding, and providing a non-rotatable connection between the shaft and brush roller body. On assembly, the shaft is placed in one half, and thereafter the halves are joined, for instance by means of riveting. The belt pulley in this construction also comprises two halves, each one being integral with the relevant half of the brush roller body.

The foregoing construction has the additional drawback of requiring unnecessarily many working steps upon assembly. Further, relatively accurate tolerances are required with respect to the grooves or slots for the shaft in the brush roller halves to ensure that the shaft is not jammed on assembly, and will not be exposed to incorrect load or at the very worst, become bent.

The principal object of the present invention is to remove the above drawbacks and disadvantages of the known brush-beater rollers for vacuum cleaners and provide a roller in which each brush-beater roller body and each drive belt pulley is an integral piece, and in which also the assembly of the parts is greatly simplified.

A further object of the present invention is to provide projections on the belt pulley corresponding in cross-sectional shape to the dovetail slots, and are securely held therein.

Another object of the present invention is to provide additional projections on the roller body for preventing the bristle holders from coming out of their respective dovetail slots.

In order that the invention will be more clearly understood, it will now be disclosed in greater detail with reference to the accompanying drawings, in which.

DESCRIPTION OF THE PREFERRED EMBODIMENT

Figure 1:
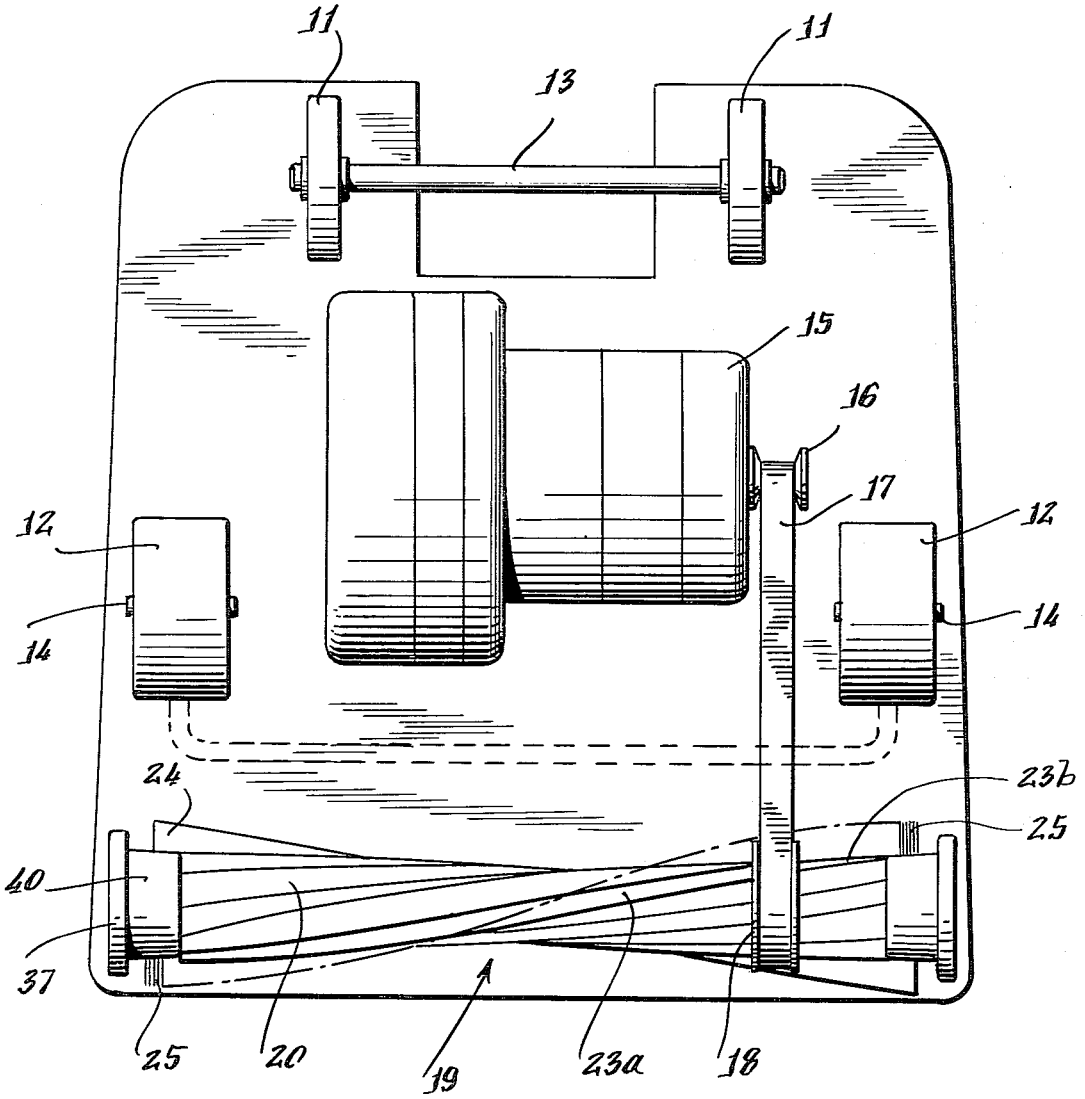
FIG. 1 is a diagrammatic bottom plan view of a so-called upright type vacuum cleaner, having a brush-beater roller constructed according to the teachings of the present invention in place therein.

FIG. 1 shows an upright-type vacuum cleaner, as seen from underneath. In such a vacuum cleaner a brush-beater roller is provided to improve the function of the vacuum cleaner in collecting dust and dirt, particularly upon cleaning of soft carpets, such as wall-to-wall carpets. By the action of the brush and beater also an effective freshing-up of the carpet surface is achieved.

As seen in FIG. 1, the vacuum cleaner comprises a casing 10 mounting the various parts of the cleaner, of which parts the drawing shows in addition to the brush-beater roller, only those necessary for the function of the roller. The casing has two pairs of wheels 11 and 12 supporting the cleaner when in use. The pairs of wheels are journalled on shafts 13 and 14, which, in a manner not shown, are secured to the casing 10. Also mounted to the casing is an electric motor 15 with a belt pulley 16 connected to the motor shaft. The pulley 16 is connected by a belt 17 to a drive belt pulley 18. The latter is firmly connected to a brush-beater roller 19, which is rotatably journalled in the casing.

Figure 2:
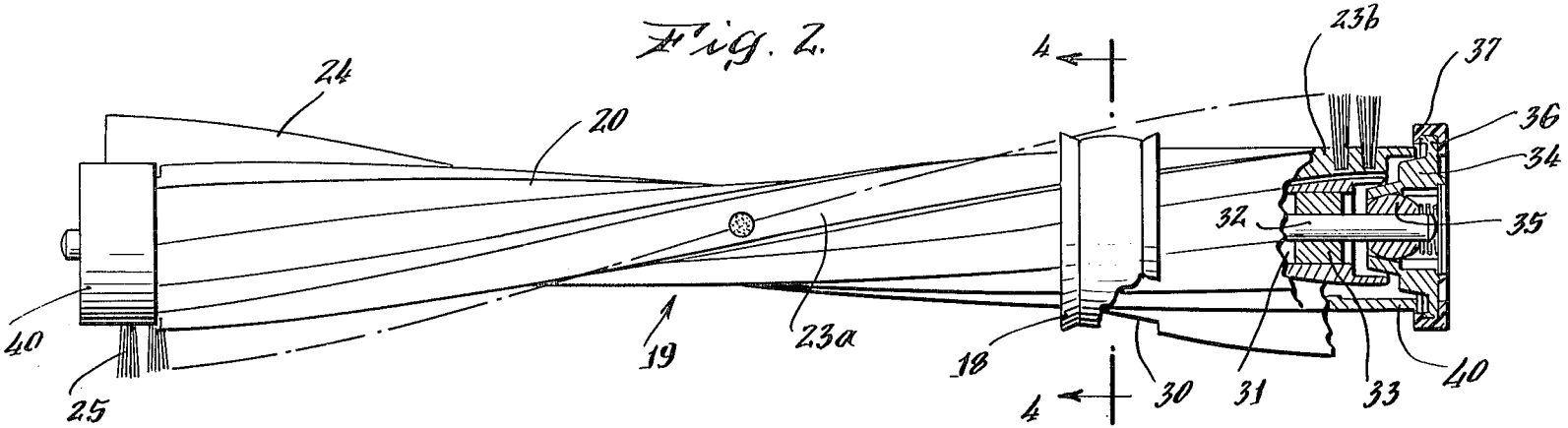
FIG. 2 is a beater-brush roller as seen in FIG. 1 but in an enlarged view, partly elevation and partly sectional.
Figure 3:
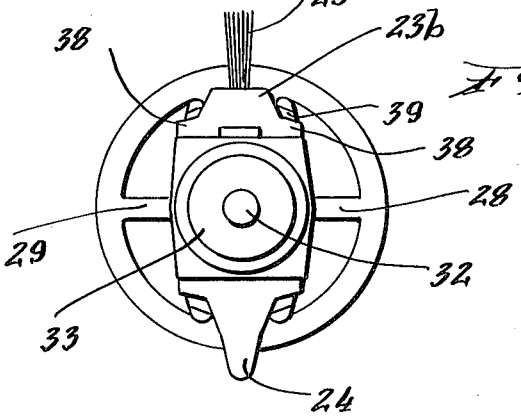
FIG. 3 is an end elevation view of the beater-brush roller shown in FIG. 2.
Figure 4:
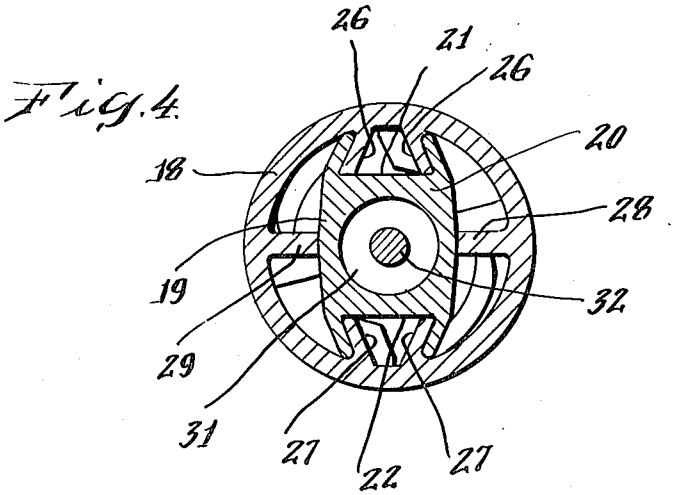
FIG. 4 is a sectional view taken along the lines IV—IV of FIG. 2.

As can be seen in FIGS. 2–4, the brush-beater roller 19 includes an elongated body 20 of generally rectangular cross section. The short sides, as appearing in the sectional view, have dovetail slots 21 and 22 forming channels to accommodate elongated holders **23*a* and 23*b* for bristle bundles 25 and a beating bar 24. The body 20 is helically twisted about its length axis in such a manner that the parts of the bristle holders 23*a* and 23*b*, at the ends of the body, are displaced 180° relative to each other. The slots 21 and 22, as seen in FIG. 4, are also arranged to receive projections 26 and 27 disposed in pairs on the drive belt pulley 18. The drive belt pulley has additional projections 28 and 29 abutting the long sides of the cross section. Thus, the pulley 18 will be well centered on the roller body. In addition, a better distribution of the load exerted on the pulley by the belt is achieved. The axial position of the pulley 18 on the body 20 is determined by a groove or slot 30 made at a suitable location in the beating bar 24** for the pulley. Therefore, the beating bar and the pulley have to be mounted simultaneously on the roller body.

A shaft 32 is positioned through a hole 31 in the roller body 20 (FIG. 4). The shaft is centered in the hole 31 and nonrotatably secured to the body 20 by means of rubber bushings 33 disposed near the ends of the body. This arrangement permits a larger tolerance to the variation in diameter of the hole 31. Moreover, the axial end portions of the shaft 32 are carefully polished to serve as bearing surfaces. As seen in FIG. 2 spherical slide bearings 35 in holders 34 are passed over the end portions of the shaft 32, and each holder 34 has a circular flange 36 over which a rubber ring 37 is pressed. The brush roller with its bearing holders 34 is mounted in the casing 10, with the holders situated in grooves (not shown) in the casing. A bottom plate also (not shown) secures the aforementioned holders to the casing 10.

When the brush roller rotates the bristle holders 23*a* and 23*b* are acted upon by a force tending to move them out of the slot 21. In order to prevent this result, the holder 23*b* has projections 38 being against shoulders 39 on the roller body 20. The holder 23*a* may be provided with hook members co-acting with corresponding hook members of the holder 23*b*. A single brush holder can be substituted for the brush holders, and in that case, the hook members can be dispensed with. The single holder must have a groove or slot for the drive belt pulley which corresponds to the groove or slot 30 in the beating bar.

In the alternative, and instead of having projections and shoulders as described above, a sleeve 40 can be passed over and be locked to the end of the roller body 20. In the embodiment shown, sleeves 40 are passed over both ends of the roller body, thus serving also as protection against entrance of threads and dust into the bearings 35. The hook members can be excluded also in this case.

As appears from the above description, the manufacture of the brush roller includes a comparatively small number of parts. For example, both the roller body 20 and the drive belt pulley 18 are integral parts, and are simple to produce by diecasting or by molding of plastic resin material. In the preferred embodiment, the body is fabricated of extruded aluminum, and made in such a manner that the hole 21 is automatically formed during the extrusion process.

The assembly of the brush roller is very simple, as follows: The belt pulley 18 is placed in the groove 30 in the beating bar 24 and these parts together are inserted in the slot 22. When the beating bar 24 has been entirely inserted, the belt pulley 18 has automatically assumed the correct axial position on the roller body 20. Then the bristle holder 23*b* is inserted in the slot 21 to one end and the holder 23*a* from the other end. The bristle holders and beating bar are locked by passing the sleeves 40 over the ends of the roller body 20. Thereafter, the shaft 32 is inserted and the rubber bushings 33 are pressed into correct positions. Then the bearing holders 34 are mounted on the ends of the shaft and the complete brush roller can be placed in and fastened to the casing after the drive belt 17 has been mounted.

While the invention has been disclosed with reference to a single embodiment, it will be apparent that variations and modifications may be made therein, and it is therefore intended in the following claims to cover each such variation and modification as falls within the true spirit and scope of the invention.

What is claimed is:

1. A brush-beater roller mounted in a vacuum cleaner housing of a vacuum cleaner comprising: an elongated roller body of a generally rectangular cross section having two short sides, means supporting said roller in said housing, a drive belt pulley on said roller body, the latter being helically twisted about its longitudinal axis and provided with, a continuous dovetail slot along the entire length of said roller body in each of said short sides, a pair of brush bristle holders and a beater bar being adapted to be accommodated in said dovetail slots, one of said dovetail slots being provided with said beater bar, said beater bar being grooved on a plurality of sides along apart of its length, corresponding to the width of said belt pulley, said groove being adapted to receive said belt pulley, obliquely inwardly directed projections on said drive belt pulley being insertable in each of said dovetail slots, said pulley being an integral ring extending peripherally about said slots, and a brush for each bristle holder, the latter being inserted in the other of said dovetail slots from opposite ends thereof to abut said inwardly directed projections.

2. A brush-beater roller mounted in a vacuum cleaner housing of a vacuum cleaner comprising: an elongated roller body of a generally rectangular cross section having two short sides, means supporting said roller in said housing, a drive belt pulley on said roller body, the latter being helically twisted about its longitudinal axis and provided with a continuous dovetail slot along the entire length of said roller body in each of said short sides, a pair of brush bristle holders and a beater bar being adapted to be accommodated in said dovetail slots, said beater bar being grooved on a part of its length corresponding to the width of said belt pulley, one of said brush bristle holders and said beater bar at one end of said roller body being provided with projections which extend laterally toward the long side of said roller body, shoulders on said roller body coacting with said projections thereby preventing movement of said beater bar and brush bristle holder toward the opposite end of said roller body, and obliquely inwardly directed projections on said drive belt pulley inserted in said dovetail slots, said pulley being an integral ring that is slid onto the roller body with said brush strip and beater bar, and said inwardly directed projections sliding in said slots for final alignment.

3. A brush-beater roller as claimed in claim 1 further comprising two additional spaced projections on said belt pulley that correspondingly abut each of the long sides of said roller body.

4. A brush-beater roller as claimed in claim 1 wherein said brush bristle holder and said beater bar at one end of the roller body are provided with projections which extend laterally toward the long sides of said roller body, and shoulders on said roller body coacting with said projections, thereby preventing movement of said beating bar and brush bristle holder toward the opposite end of said roller body.

5. A brush-beater roller as claimed in claim 1 wherein said roller body has a central through hole extending along the longitudinal axis of said body, a shaft disposed in said through hole, the diameter of said hole substantially exceeding the diameter of said shaft, the latter being supported in said vacuum cleaner housing at the ends of said roller body, and at least two annular rubber bushings non-rotatably connecting said shaft to said roller body.

* * * * *